US005280823A

United States Patent [19]

Chabot

[11] Patent Number: 5,280,823

[45] Date of Patent: Jan. 25, 1994

[54] APPARATUS FOR REGAINING CONTROL OVER OIL AND GAS FLOWING FROM "BLOW OUT" WELLS

[76] Inventor: Steve Chabot, 8 Mardale Crescent, Sherwood Park, Alberta, Canada, T8A 3N5

[21] Appl. No.: 980,773

[22] Filed: Nov. 24, 1992

[30] Foreign Application Priority Data

Dec. 4, 1991 [CA] Canada ..... 2056917

[51] Int. Cl.[5] ..... E21B 29/00

[52] U.S. Cl. ..... 166/55

[58] Field of Search ..... 166/55-55.8, 166/79, 82, 92, 93, 297

[56] References Cited

U.S. PATENT DOCUMENTS 3,399,728 9/1968 Taylor ..... 166/55 X
3,693,715 9/1972 Brown ..... 166/55
3,732,924 5/1973 Chelette et al. ..... 166/55
3,789,689 2/1974 Mace ..... 166/55

*Primary Examiner*—Thuy M. Bui
*Attorney, Agent, or Firm*—Davis, Bujold & Streck

[57] ABSTRACT

An apparatus for regaining control over the flow of oil and gas from "blow out" wells having a housing consisting of two portions which are adapted to be fastened around an insitu well casing. The housing has a top, a bottom, an exterior surface and a central passage. The housing is rotatably secured to the insitu well casing, such that the well casing extends through the central passage. Cutters are provided which communicate with the central passage of the housing. Upon rotation of the housing the cutters move systematically around the circumference of the insitu well casing until it is severed. Rams are positioned adjacent the top of the housing for closing the central passage upon the severing of the well casing.

4 Claims, 6 Drawing Sheets

APPARATUS FOR REGAINING CONTROL OVER OIL AND GAS FLOWING FROM "BLOW OUT" WELLS

The present invention relates to an apparatus for regaining control over oil and gas flowing from "blow out" wells.

BACKGROUND OF THE INVENTION

In the oil and gas industry a "blow out" occurs when there is an uncontrolled flow of gas and oil from a well. A device used to prevent the uncontrolled release of gas or oil from a well while drilling is in progress is called a "blow out preventor" or "BOP". The BOP is attached by means of a flange to a casing bowl welded to the top of the well casing. If, for any reason, the BOP should fail to function an uncontrolled flow of oil and gas will occur. Often this uncontrolled flow of gas and oil is ignited by a spark and the ensuing fire reduces on surface equipment to twisted metal which hinders attempts to regain control of the flow. Personnel fighting the fire can readily extinguish the fire, however, there is an extreme danger of the oil and gas being reignited unless the flow is controlled. Before the flow can be controlled, the casing is cut off below the casing bowl to remove the faulty BOP and another and casing bowl is welded in place and a new BOP installed. With gas and oil flowing from the well this is a very difficult and dangerous procedure.

SUMMARY OF THE INVENTION

What is required is an apparatus for regaining control over the flow of oil and gas from "blow out" wells which has the capability of being installed on the well casing before the damaged BOP has been removed.

According to the present invention there is provided an apparatus for regaining control over the flow of oil and gas from "blow out" wells which is comprised of a housing consisting of two portions which are adapted to be fastened around an insitu well casing. The housing has a top, a bottom, an exterior surface and a central passage. Means are provided for rotatably securing the housing to the insitu well casing, such that the well casing extends through the central passage. Cutting means are provided which communicate with the central passage of the housing. Means are provided for rotating the housing such that the cutting means is systematically directed around the entire circumference of the insitu well casing thereby severing the well casing. Means are positioned adjacent the top of the housing for closing the central passage upon the severing of the insitu well casing.

The apparatus as described is capable of cleanly severing the well casing. It is preferred that the cutting means used by jets of high pressure fluids. Means is provided to rotate the housing, as will be hereinafter further described, so that the jet of cutting fluid travels around the circumference of the well casing to sever it cleanly.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
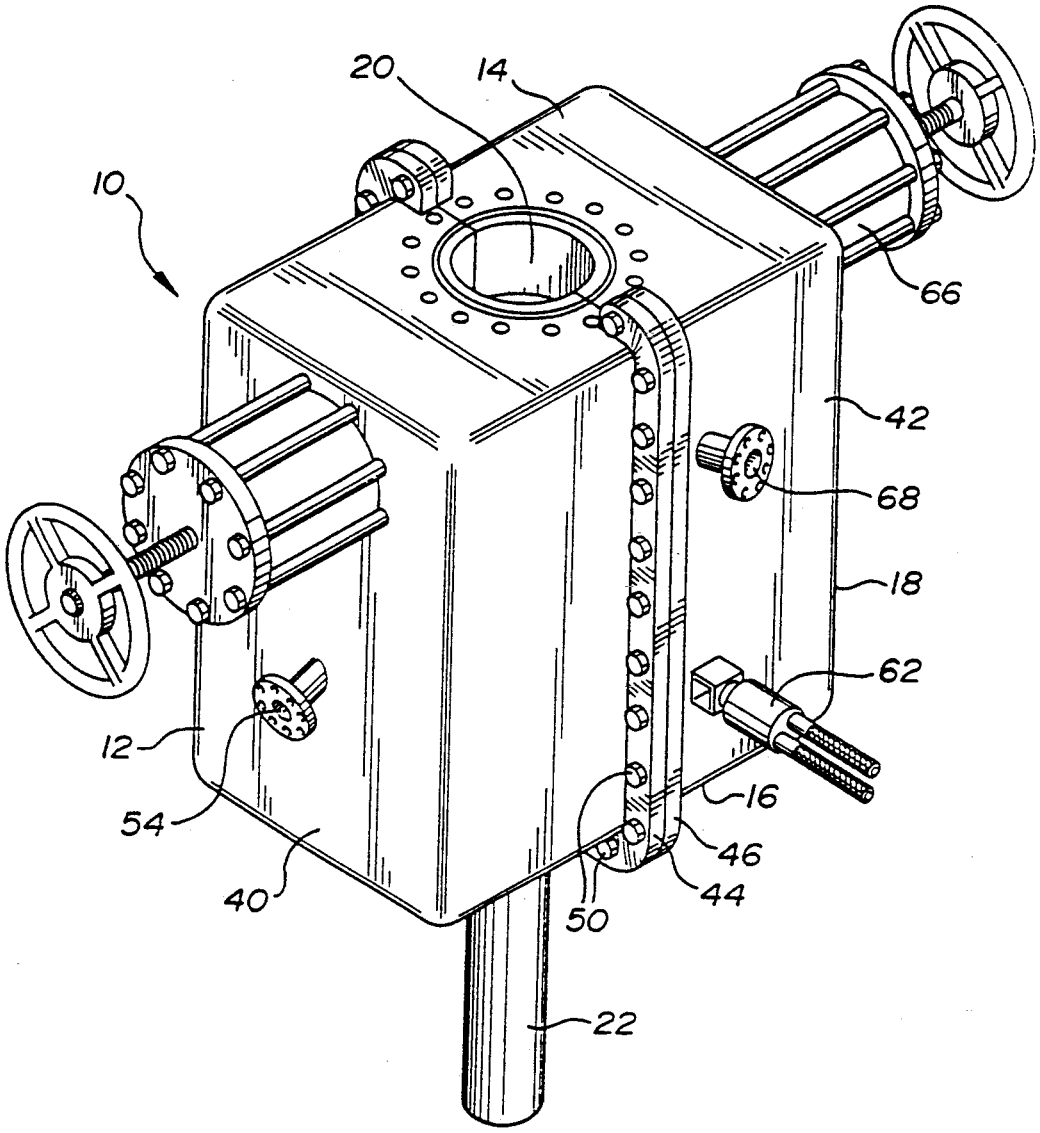
FIG. 1 is a perspective view of an apparatus for regaining control over the flow of oil and gas from "blow out" wells constructed in accordance with the teachings of the present invention.

The preferred embodiment, an apparatus for controlling the flow of gas and oil from blow out wells generally identified by reference numeral 10, will now be described with reference to FIGS. 1 through 6.

Figure 2:
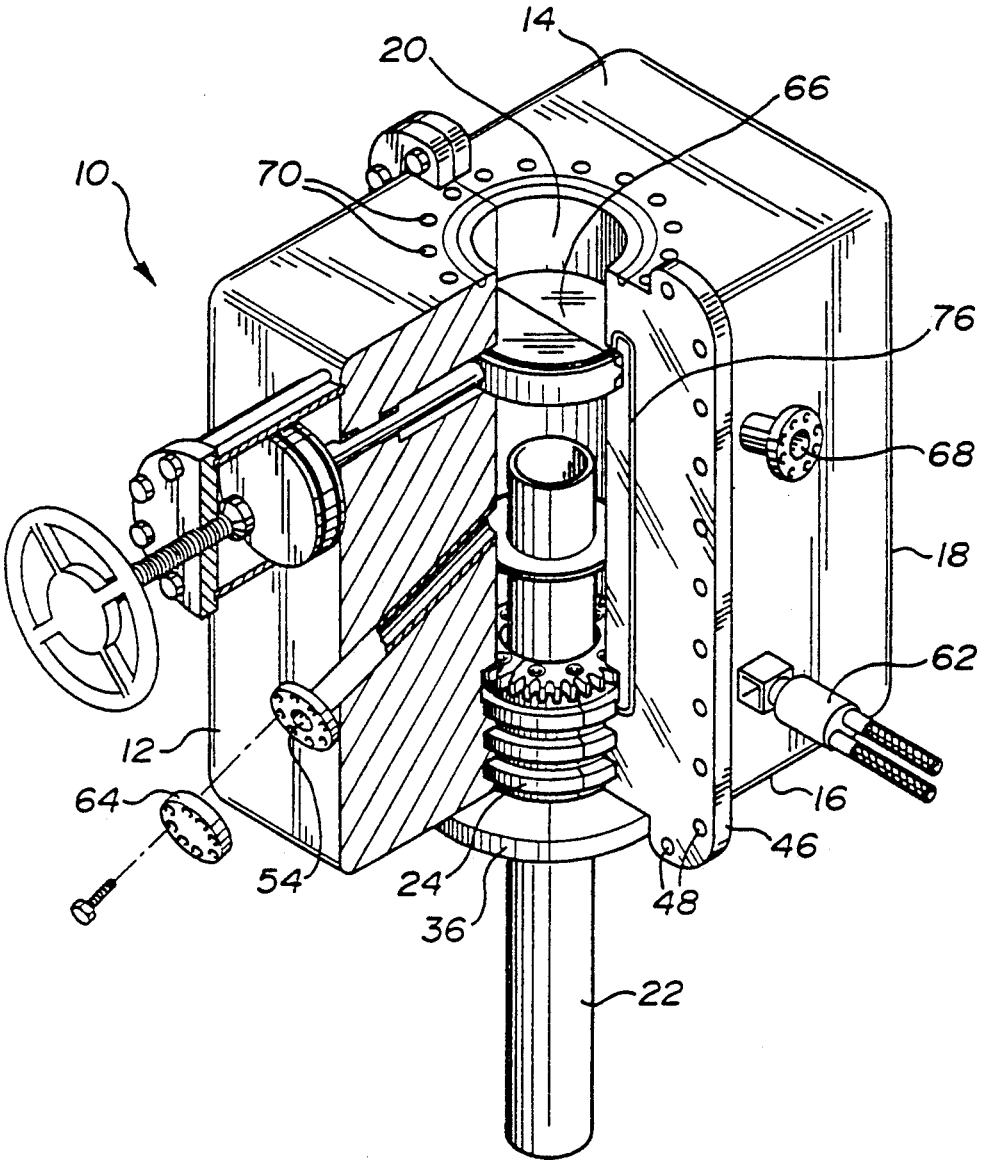
FIG. 2 is a cut away perspective view of the apparatus illustrated in FIG. 1.
Figure 3:
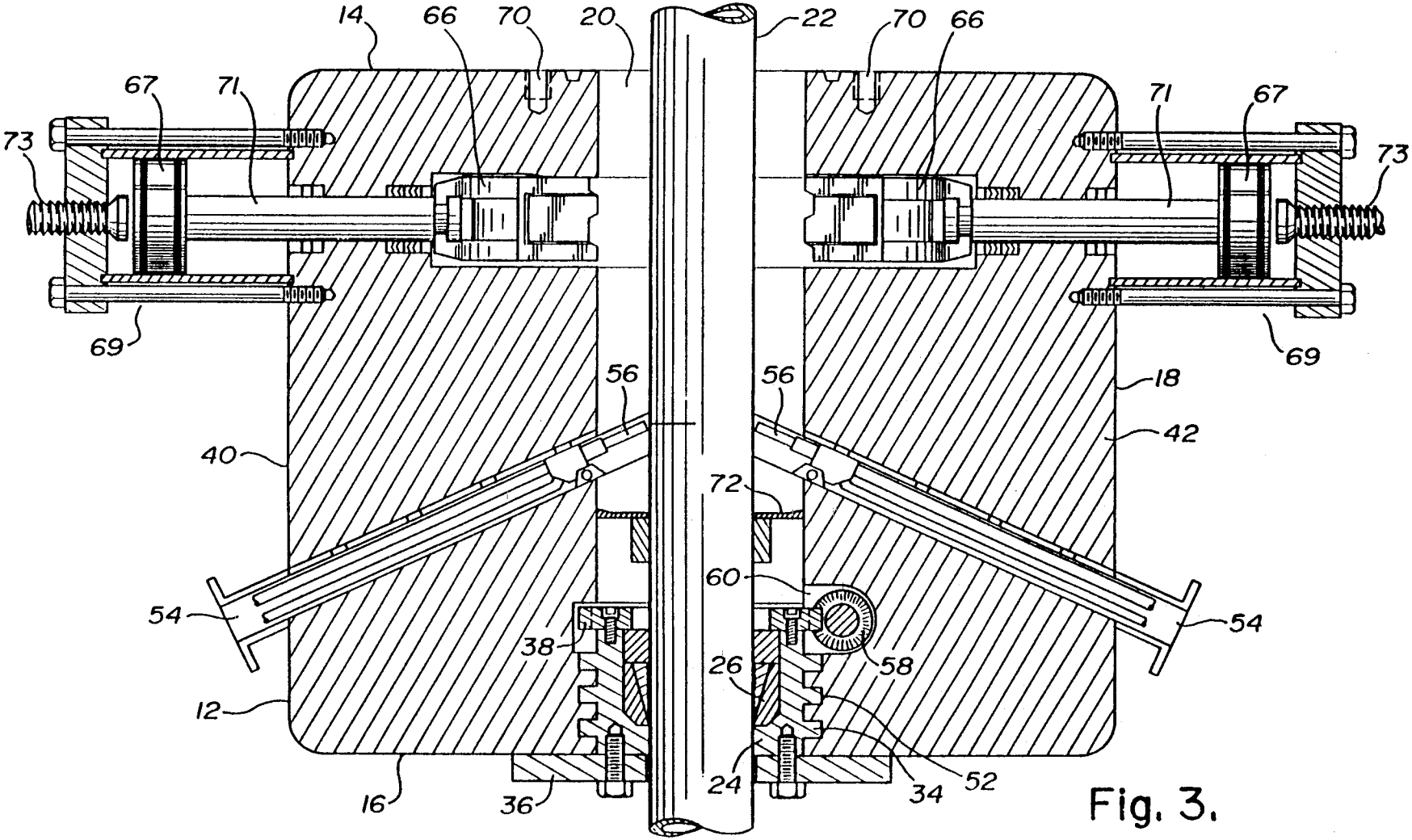
FIG. 3 is a longitudinal section view taken along section line 3—3 of FIG. 1.
Figure 4:
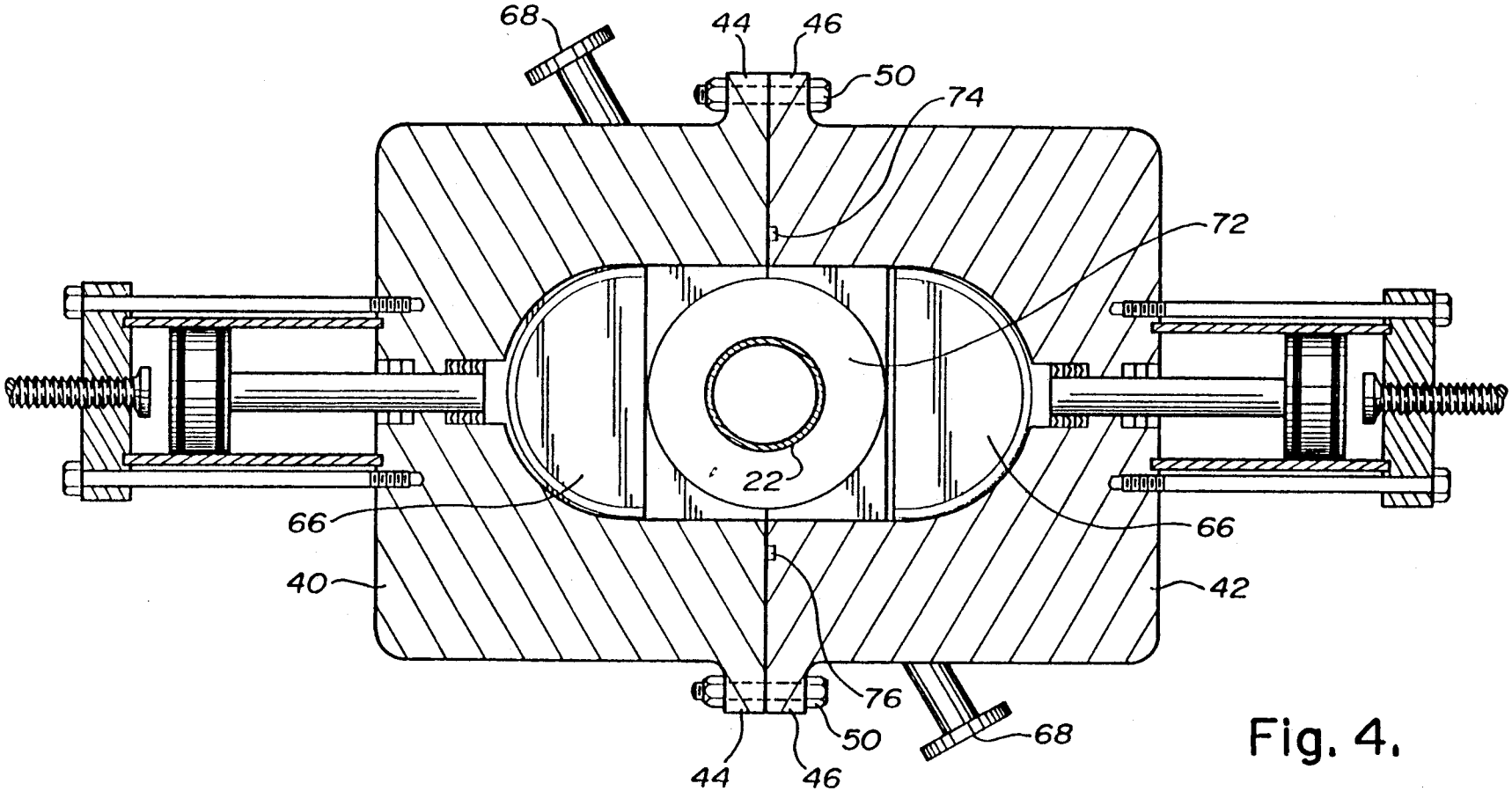
FIG. 4 is a transverse section view taken along section line 4—4 of FIG. 1.
Figure 5:
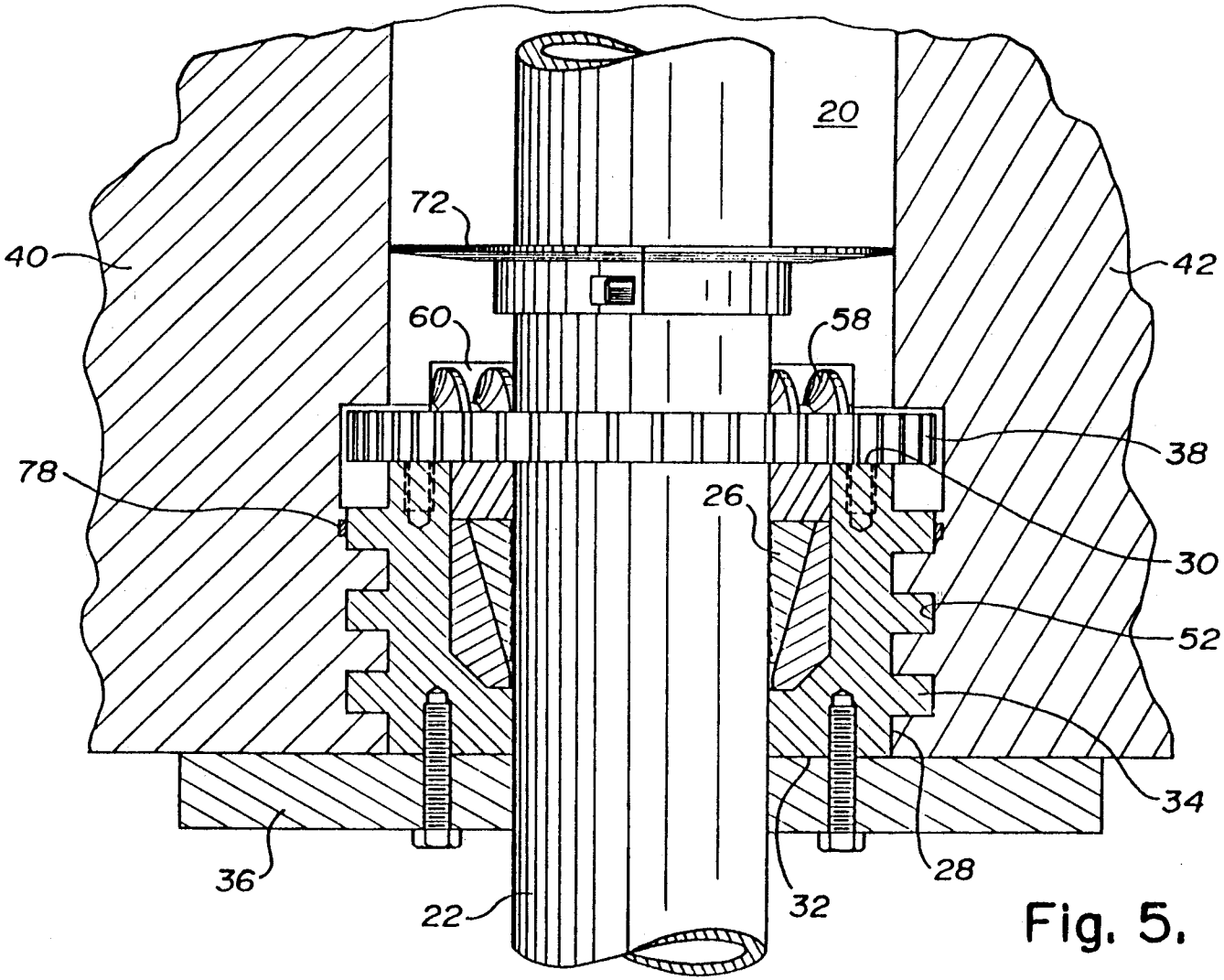
FIG. 5 is a detailed view of a portion of the apparatus illustrated in FIG. 1.
Figure 6:
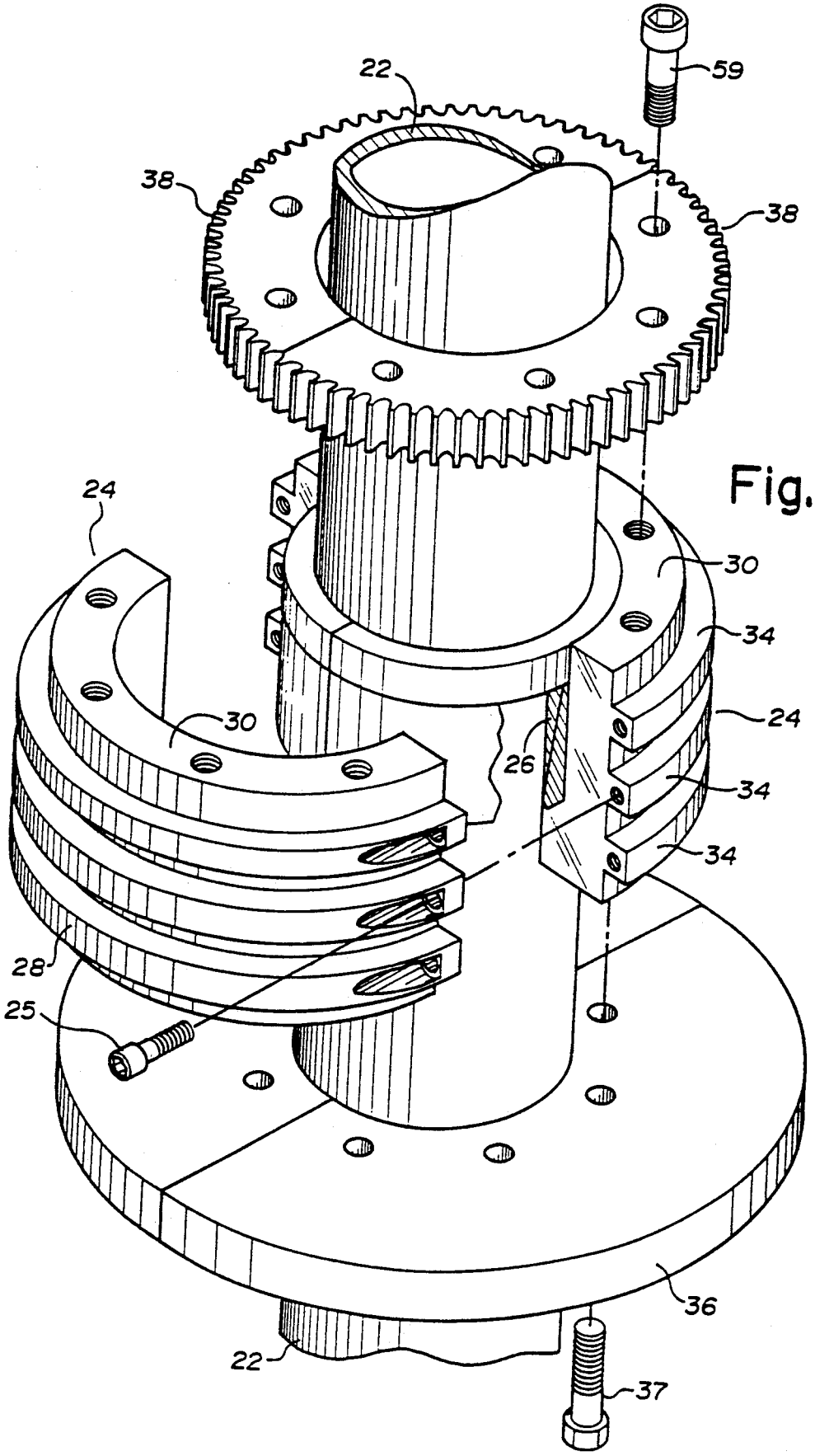
FIG. 6 is an exploded perspective view of an adaptor unit illustrated in FIG. 2.

Referring to FIGS. 1 and 2, apparatus 10 has a housing 12 with a top 14, a bottom 16, an exterior surface 18 and a central passage 20 which extends between top 14 and bottom 16 of housing 12. It is intended that housing 12 be secured to an insitu well casing 22. The means used to secure housing 12 to well casing 22 is an two part adaptor unit 24 which is secured together by inset screws 25. Referring to FIGS. 3, 5 and 6, adaptor unit 24 has a plurality of internal wedges 26. Wedges 26 are arranged such that when pressure is exerted from below urging adaptor unit 24 upwardly, wedges 26 tightly grip well casing 22. When adaptor unit 24 is in position well casing 22 extends through central passage 20. Adaptor unit 24 has an exterior surface 28, a top 30 and a bottom 32. Exterior surface 28 has a plurality of annular projections 34. A platform 36 is secured by bolts 37 to bottom 32. A gear 38 is secured by bolts 59 to top 30. Referring to FIGS. 1 and 2, housing 12 comes in two sections 40 and 42 having flanges 44 and 46, respectively. Flanges 44 and 46 have a plurality of openings 48 which are adapted to receive bolts 50 for the purpose of securing sections 40 and 42 together to form housing 12. Referring to FIGS. 3 and 5, when sections 40 and 42 are bolted together they are first rested upon platform 36 and then slid into position around exterior surface 28 of adaptor unit 24. Central passage 20 of housing 12 has annular grooves 52 which matingly engage annular projections 34 on exterior surface 28 of adaptor unit 24. When annular projections 34 are mated with annular grooves 52 housing 12 is secured against axial movement in relation to adaptor unit 24, while permitting housing 12 to rotate about adaptor unit 24. Adaptor unit 24 is fixed to well casing 22 by means of internal wedges 26 and does not turn. Fluid jet cutter receiving passages 54 extend upwardly at an angle from exterior 18 of housing 12 into central passage 20. Fluid jet cutters 56 are inserted into fluid jet cutter receiving passages 54 for the purpose of cutting with fluid jets well casing 22. In order to cut completely around well casing 22 means must be provided for slowly rotating housing 12 at a constant velocity such that a jet of high pressure fluid from fluid jet cutter 56 positioned in fluid jet cutter receiving passage 54 is systematically directed around the entire circumference of insitu well casing 22 thereby severing well casing 22. The means used is a worm gear 58 rotatably mounted in a pocket 60 adjacent central passage 20 which engages gear 38 secured to top 30 of adaptor unit 24. Worm gear 58 is rotated by means of an hydraulic motor 62. A closure cap 64 is used to close fluid jet cutter receiving passage 54 when fluid jet cutter 56 is withdrawn. Hydraulic rams 66 positioned adjacent top 14 of housing 12 are used as means for closing central passage 20 upon removal of the severed portion of insitu well casing 22. Referring to FIG. 3, hydraulic rams 66 are operated by pistons 67 contained in cylinders 69 with a connecting shaft 71 which links piston 67 with rams 66. As a safety measure hydraulically operated rams 66 have screw type locking mechanisms 73. Referring to FIGS. 1 and 2, an additional passage 68 is provided through housing 12 from exterior 18 to central passage 20, which may be used after rams 66 have sealed off central passage 20 to pump drilling mud down into the borehole as part of the process of regaining control of the well. A ring of threaded holes 70 is provided on top 14 of housing 12 to facilitate the attachment of an adaptor flange (not shown). A wiper seal 72 attaches to well casing 22 immediately above worm gear 58 for the purpose of shielding worm gear 58 from abrasive cutting fluids used in the cutting process. Several seals are used to maintain oil and gas within housing 12. Seals 74 and 76 are positioned longitudinally between sections 40 and 42 of housing 12 to prevent fluids from passing between sections 40 and 42. An annular seal 78 is positioned where annular projections 34 of adaptor unit 24 engage annular grooves 52 of housing 12 to prevent fluids from passing between the well casing and the central passage.

The use and operation of apparatus 10 will now be further described with reference to FIGS. 1 through 6. Firefighting personnel who arrive at the site of a blow out first pull the majority of the twisted debris from the immediate vicinity of the well to provide access and then extinguish the flame. At this point there will remain well casing which is for the most part buried with the remains of the blow out preventer resting on top. The personnel excavate around the well casing to provide a working area and expose a portion of well casing 22 to which apparatus 10 may be secured. The two portions of adaptor unit 24 are then secured to well casing 22 and bolted together. Wiper seal 72 is attached to well casing 22 immediately above gear 38. Sections 40 and 42 of housing 12 are placed upon platform 36 on bottom 32 of adaptor unit 24, and slid into place with flanges 44 and 46 abutting, openings 48 in register, and annular projections 34 engaging annular grooves 52. Bolts 50 inserted into openings 48 to secure sections 40 and 42 together. Fluid jet cutters 56 are then inserted into fluid jet receiving passages 54. When in fluid jet cutters 56 are in position they extend into central passage 20 and are immediately adjacent well casing 22, as illustrated in FIG. 3. Fluid jet cutters 56 are preferably maintained within fluid jet cutter receiving passages 54 by an elastic stay (not shown). The elastic stay biases fluid jet cutters 56 against well casing 22, such that fluid jet cutters 56 follow the surface contour of well casing 22 moving inwardly into depressions and outwardly over bumps to maintain a relatively constant cutting distance. The farther back in fluid jet cutter receiving passages 54 that fluid jet cutters 56 are positioned, and the more the cutting distances fluctuate, the greater the possibility that the cut made by the two fluid jet cutters 56 will not coincide. If the cuts do not coincide the cut will be of inferior quality, or in a worse case scenario well casing 22 will not be severed. Effective fluid jet cutting requires a slow movement at a constant velocity across the workpiece being cut. This is achieved by activating motor 62 which rotates worm gear 58. As worm gear 58 rotates it engages gear 38 on top 30 of adaptor unit 24. The engagement of worm gear 58 and gear 38 causes housing 12 to rotate as adaptor unit 24 is fixed to well casing 22. Worm gear 58 moves around gear 38 causing housing 12 to rotate around adaptor unit 24, the engagement of annular grooves 52 of housing 12 with annular projections 34 of adaptor unit 24 accommodating such rotational movement. A line (not shown) would normally be attached to the portion of well casing 22 being severed so that it does not become a fluid driven projectile upon being severed. Fluid jet cutters 56 are capable of cutting into housing 12, if appropriate precautions are not taken. Angling fluid jet cutter receiving passages 54 upwardly, as illustrated in FIGS. 2 and 3, from exterior surface 18 toward central passage 20 ensures that the jet of high pressure fluid used in cutting enters the stream of oil and gas escaping through well casing 22 minimizing the risk of housing 12 being damaged. It is common to use abrasives in the fluid used for cutting. These abrasives are capable of causing premature wearing of worm gear 58 and gear 38. Referring to FIGS. 2 and 5, it can be seen how wiper seal 72 shields worm gear 58 and gear 38 from the abrasive cutting fluid. Once well casing 22 has been cut with fluid jet cutter 56, it appears as illustrated in FIG. 2. Fluid jet cutters 56 are then withdrawn from fluid jet cutter receiving passages 54 and closure caps 62 are put in place to prevent the escape of fluids through fluid jet cutter receiving passages 54. Rams 66 are then moved into a position closing off central passage 20, thereby shutting off and controlling the flow through well casing 22. The force of the oil and gas is exerted directly upon rams 66. This force has a tendency to force housing 12 upwardly. Housing 12 would become a fluid driven projectile if it were not securely fastened to well casing 22. Housing 12 is held in place through the engagement of annular projections 34 from adaptor unit 24 with annular grooves 52 of housing 12. Housing 12 will remain in place as long as adaptor unit 24 remains in place. Adaptor unit 24 is held in place by the engagement between wedges 26 and well casing 22. The greater the force attempting to dislodge adaptor unit 24, the more tightly wedges 26 grip well casing 22. The oil and gas confined by rams 66 within housing 12 will seek alternate routes to escape. In the absence of seals, housing 12 would be operative but it would be subject to leakage. Once leakage begins to occur the pressures the leaking fluids are under can cause a washing away of housing 12. Seals 74 and 76 illustrated in FIG. 4 address this problem of leakage. It can be seen by examining the view of seal 76 provided by FIG. 2, that seals 74 and 76 provide a longitudinal seal between sections 40 and 42 of housing 12. Another path of escape for fluids trapped within housing 12 is between central passage 20 and well casing 22. This path is partially obstructed by the engagement between annular projections 34 on adaptor unit 24 and annular grooves 52 within central passage 20 of housing 12. Seal 78, as illustrated in FIG. 5, seals this area. If rams 66 were reopened the flow of oil and gas through well casing 22 would resume. Additional passage 68 is used in the process of regaining control over the well. Additional passage 68 can be connected to a source of drilling fluids. By pumping drilling fluids down the well under pressure, the flow of oil and gas from the well can be smothered. In addition, ring of threaded holes 70 allow for other equipment to be secured to top 14 of housing 12.

It will be apparent to one skilled in the art that apparatus 10 provides a means for cleanly severing well casing 22. It will also be apparent to one skilled in the art that the invention can be adapted for use with other types of cutters other than fluid jet cutters. It will also be apparent to one skilled in the art that modifications may be made to apparatus 10 as illustrated without departing from the spirit and scope of the invention as defined by the claims.

THE EMBODIMENTS OF THE INVENTION IN WHICH AN EXCLUSIVE PROPERTY OR PRIVILEGE IS CLAIMED ARE DEFINED AS FOLLOWS:

1. An apparatus for regaining control over the flow of oil and gas from "blow out" wells, comprising:

a. a housing consisting of two portions which are adapted to be fastened around an insitu well casing, the housing having a top, a bottom, an exterior surface and a central passage, b. means for rotatably securing the housing to the insitu well casing, such that the well casing extends through the central passage;

c. cutting means communicating with the central passage of the housing;

d. means for rotating the housing such that the cutting means is systematically directed around the entire circumference of the insitu well casing thereby severing the well casing; and e. means positioned adjacent the top of the housing for closing the central passage upon the severing of the insitu well casing.

2. The apparatus as defined in claim 1, the cutting means being a fluid jet cutter positioned in a fluid jet cutter receiving passage which extends upwardly at an angle from the exterior of the housing to the central passage.

3. The apparatus as defined in claim 1, having sealing means to prevent the escape of fluids from the housing when the central passage is closed.

4. An apparatus for regaining control over the flow of oil and gas from "blow out" wells, comprising:

a. a housing consisting of two portions which are adapted to be fastened around an insitu well casing, the housing having a top, a bottom, an exterior surface and a central passage;

b. means for securing the housing to the well casing; at least one fluid jet cutter receiving passage extending upwardly at an angle from the exterior of the housing into the central passage;

c. means for slowly rotating the housing at a constant velocity such that a jet of high pressure fluid from a fluid jet cutter positioned in the fluid jet cutter passage is systematically directed around the entire circumference of the insitu well casing thereby severing the well casing;

d. closure means to close the fluid jet cutter receiving passage;

e. means positioned adjacent the top of the housing for closing the central passage upon removal of the severed portion of the insitu well casing; and f. sealing means to prevent the escape of fluids from the housing when the central passage is closed.

* * * * *